US008024902B2

(12) United States Patent
Wedi

(10) Patent No.: US 8,024,902 B2
(45) Date of Patent: Sep. 27, 2011

(54) SHAPED PROFILE ASSEMBLY TO BRIDGE A CONSTRUCTION ELEMENT JOINT

(76) Inventor: Stephan Wedi, Kolpingstrasse (DE)

( * ) Notice: Subject to any disclaimer, the term of this patent is extended or adjusted under 35 U.S.C. 154(b) by 442 days.

(21) Appl. No.: 12/228,552

(22) Filed: Aug. 14, 2008

(65) Prior Publication Data

US 2008/0307732 A1 Dec. 18, 2008

(30) Foreign Application Priority Data

Sep. 14, 2007 (DE) ..... 10 2007 043 983

(51) Int. Cl.
*E04B 1/62* (2006.01)

(52) U.S. Cl. ..... 52/395; 52/393; 52/396.01; 52/459; 52/461; 52/573.1

(58) Field of Classification Search ..... 52/393, 52/395, 396.01, 459, 461, 469, 573.1, 309.12, 52/309.17, 396.04, 465, DIG. 8
See application file for complete search history.

(56) References Cited

U.S. PATENT DOCUMENTS 3,864,886 A * 2/1975 Thom ..... 52/469
7,036,284 B1 * 5/2006 Larson ..... 52/506.1

FOREIGN PATENT DOCUMENTS

DE 1 934 771 7/1969

* cited by examiner

*Primary Examiner* — Brian Glessner
*Assistant Examiner* — Gisele Ford
(74) *Attorney, Agent, or Firm* — Karl F. Milde, Jr.; Eckert Seamans Cherin & Mellott, LLC

(57) ABSTRACT

A one-piece or multiple-piece shaped profile assembly that is used for bridging a construction element joint (2), namely expansion joints or displacement joints between two construction elements (3.1; 3.2). This assembly is shaped as a stiff joint bridge with two vertical mirror-image shaped profiles (5, 6) facing each other at both joint edges that are connected together by means of a shaped bridging profile (7) extending across the construction element joint (2). At least one of the vertical profile pieces (5, 6) is adjustable with respect to the opposing construction element to compensate for the relative displacement between the construction elements (3.1; 3.2). The vertical profile pieces (5, 6) and shaped bridging profile (7) comprise a hard polymer foam that is coated with an armoring mortar layer as an adhesive base for an additional coating layer (11).

8 Claims, 1 Drawing Sheet

SHAPED PROFILE ASSEMBLY TO BRIDGE A CONSTRUCTION ELEMENT JOINT

BACKGROUND OF THE INVENTION

The invention relates to a one-piece or multiple-piece shaped profile assembly for bridging a construction element joint, namely expansion joints or displacement joints between two construction elements, shaped as a stiff joint bridge with two mirror-image vertical shaped profiles facing each other at both joint edges that are connected together by means of a shaped bridging profile extending across the construction element joint. At least one of the vertical profile pieces is mounted to be adjustable with respect to the opposing construction element to compensate the relative displacement between the construction elements.

Such a shaped profile assembly is known from the German Utility Model Patent No. 1,934,771. Here, two wall-shaped filler strips are connected together using a bridge-type covering strip that may be extruded from plastic or metal. Relatively high machine-tool costs are required to produce the covering strip. Thermal insulation is not practically provided in the joint area.

SUMMARY OF THE INVENTION

The principal objects of the present invention are to provide a shaped profile assembly as a joint-bridging element for a construction element, in which a material widely used in the construction industry affording a high degree of thermal insulation is usable as the base material, and for which it is also possible to continue an existing outer layer from an adjacent construction element, particularly a color layer or planking, across the shaped profile assembly without gaps.

These objects are achieved, according to the present invention, by providing a shaped profile assembly of the above-mentioned type in which the vertical profile pieces and the shaped bridging profile consist of a hard polymer foam that is coated with an armoring mortar layer as an adhesive base for an additional coating layer.

Hard polymer foams suitable for the shaped profile assembly are known. In particular, extruded polystyrene hard foam products are used. Other polymers are also usable e.g., hard foam of the base material polyurethane, or foams based on phenol resin. This type of foam may be adjusted regarding temperature resistance and other physical parameters in many ways, as is known to the specialist.

Plate-shaped foam material is often used as an initial material from which the shaped profile assembly is produced as one piece. It is also possible, however, to extrude rectangular shapes overall as a hard-foam base body and then apply any coating.

A shaped profile assembly may be produced without great machine-tool expense if it consists of two or three joined shaped profiles that are provided with a one-piece armoring coating of fiber material on the outer side of the joint bridge.

A further option exists to cut to size the assembled shaped profiles made of a hard-foam sandwich plate into which two V-shaped miter cuts are made, and whose depth is so selected that the armoring coating is almost reached but not cut through. Subsequently, the resulting shaped profiles are joined into a stiff joint bridge in the area of the miter cuts by the armoring coating.

Fiberglass fabric or fleece is particularly well-suited as an armoring coating.

The vertical profile piece connected with the construction element so that it may be adjusted is preferably connected with the pertinent construction element by means of a long-term plastic layer. Such a long-term plastic layer may, for example, consist of a poly-sulfide rubber, long-term elastic polyurethane filler, or ethylene-propylene rubber.

It is advantageous in the shaped profile assembly to use the space below the shaped profile assembly as a cable or wire channel, or partially or completely to embed the cable or lines in the hard foam.

Finally, in the shaped profile assembly, when it is mounted on a building façade and over a construction element joint so that the both sides of the construction element joint possess the same surface treatment, one may provide the outer layer of the building façade on both sides of the construction element joint such that the outer layer, particularly a coat of paint or planking extends without loopholes across the shaped profile assembly.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
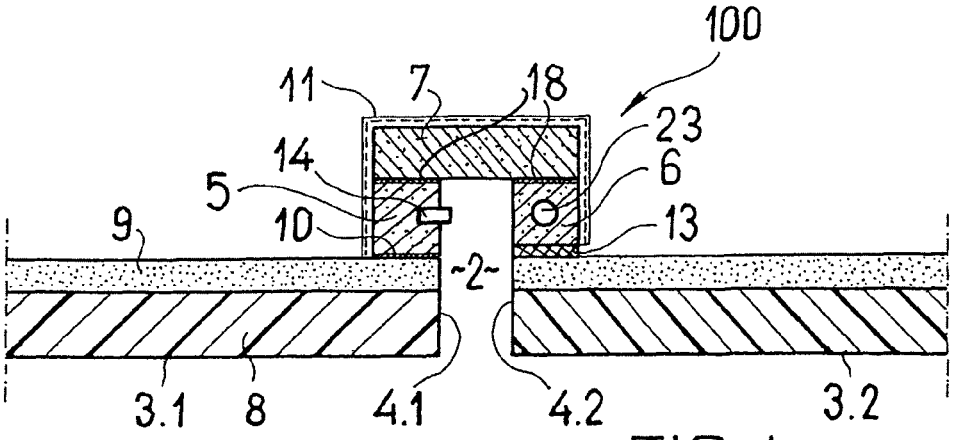
FIG. 1 is a cross-sectional view of a shaped profile assembly, according to the invention, for bridging a construction element joint.

The preferred embodiments of the present invention will now be described with reference to FIGS. 1-2*b* of the drawings. Identical elements in the figures are designated with the same reference numerals.

FIG. 1 shows a shaped profile assembly 100 by means of which a construction element joint 2, namely an expansion joint or displacement joint, is bridged between two construction elements 3.1, 3.2. The shaped profile assembly 100 as shown in FIG. 1 is shaped as a stiff joint bridge. Two essentially mirror-image vertical profile pieces 5 mounted on the joint edges 4.1 and 4.2 and 6 positioned facing each other are connected together by means of a shaped bridging profile 7 bridging the construction element joint 2 and the separation between the two vertical profile pieces 5 and 6. An adhesive connection 18 serves as joint filler.

The two construction elements 3.1 and 3.2 consist in this case of joined façade plates 8 with a mounted cleaning layer 9. The joint edges 4.1 and 4.2 may also be damaged, whereby the shaped profile assembly covers the damage.

The vertical profile pieces 5 and 6 and the shaped bridging profile 7 consist of a polystyrene hard foam material. Other hard foam materials such as polyurethane foam, phenol resin foams, and similar may be used. It is incumbent on the specialist to select foam materials suited to temperature and ambient extremes such as demonstrated in the book "The Art of Plastics" published by Schwarz/Ebeling, Vogel Buchverlag, 8th Edition.

The polymer hard-foam body of the vertical profile pieces 5, 6 and of the shaped bridging profile 7 and thereby the shaped profile assembly 100 is covered with an armoring mortar layer 11 that consists of a plastic-enriched silicate mortar. A woven glass-fiber mat is inserted into the mortar before it hardens that forms an armor after hardening. The grid width of the glass-fiber fabric lies between 5 and 15 mm. The initial plate material for such foam bodies is known as a "WEDI plate" (Manufacturer: WEDI GmbH, Emsdetten, Germany).

The free upper sides of the vertical profile pieces 5, 6 are joined to the underside of the shaped bridging profile. The foot of the vertical profile piece 5 in turn is firmly attached to the cleaning layer 9 by means of an adhesive layer 10.

The other vertical profile piece 6 is mounted so that it may be displaced or dislocated to compensate for relative displacement between the construction elements 3.1 and 3.2. The construction elements 3.1 and 3.2 moving below the stiff joint bridge because of thermal expansion are not firmly affixed to the vertical profile piece 6. The underside of the vertical profile piece 6 is connected with the upper side of the construction element 3.2 by means of a long-term plastic layer 13. The long-term plastic 13 consists of a long-term plastic or elastic plastic, and the specialist has various products available to himself. Reference is again made to the book "The Art of Plastics". The following plastics are examples of suitable materials: polysulfide rubber, long-term elastic polyurethane filler or ethylene-propylene rubber. It must also be emphasized that the vertical profile pieces 5 and 6 may be bent by a small amount so that additional displacement-equalizing deformation of the shaped profile may be undertaken.

The dimensions of the shaped profile assembly 100 are variable. The initial material preferably possesses a thickness of about 5 to 12 cm, and the mortar layer possesses a thickness of about 1 to 3 mm. The distance from the outer side of the construction element to the outer side of the shaped profile assembly parallel to it is about 5 to 20 cm, whereby these dimensions serve merely as an example and not as a limitation.

Figure 2A:
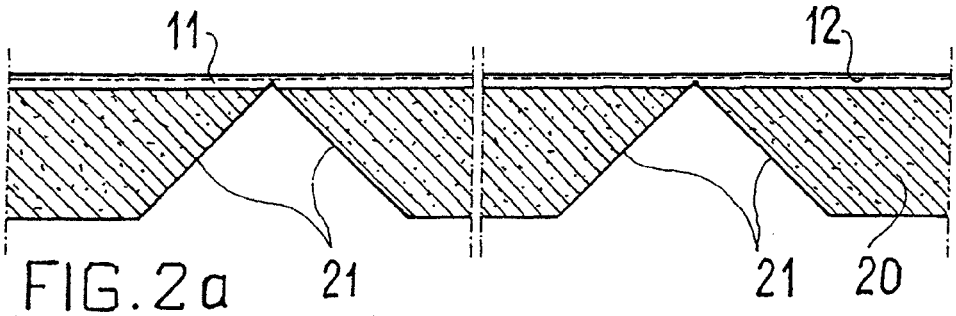
FIG. 2*a* is a cross-sectional view of a hard-foam plate prepared for the production of a shaped profile assembly and provided with miter-joint cutouts.

A type of manufacture for the shaped bridging profile assembly 100' is particularly advantageous in which one begins with a hard-foam sandwich plate 20 provided on one side with an armoring mortar layer as shown in FIG. 2*a*. In such a sandwich plate 20, two V-shaped miter-joint cuts 21 are cut whose depth is so selected that the armoring layer 22 is almost reached, but is not cut through. This results in a three-part plate shaped profile that may be bent into shaped profile assembly 100' per FIG. 2*b*, whereby the mortar layer breaks, but the armoring 22 of glass-fiber fabric remains and surrounds the corners. The jaws of the 90° miter cuts are overlaid and bound together with adhesive.

Reference is also made to the fact that cables 23 or tubing lines 14 may be partially or completely embedded in the hard foam, as FIG. 1 shows.

Figure 2B:
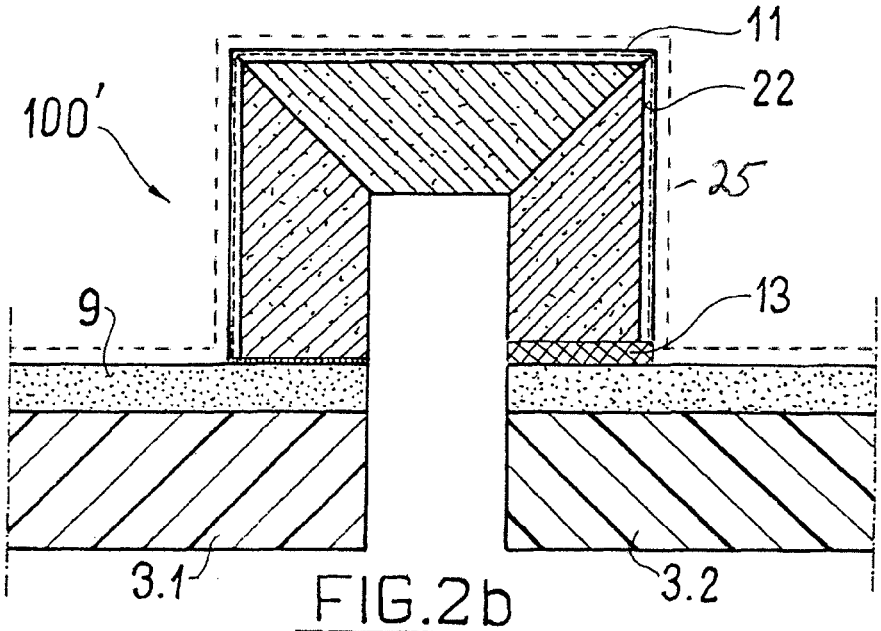
FIG. 2*b* shows the assembled shaped profile assembly using a semi-finished product as in FIG. 2*a*.

If the shaped profile assembly 100' is applied to a building façade and placed over a construction element joint for which the outer layer of the building façade is to possess the same texture on both sides of the construction element joint 2, then a fleece or planks may be drawn over the shaped profile assembly without gaps, as shown at 25 in FIG. 2*b*. Even a coat of paint may be applied without complication in a similar manner as the mortar of the outermost mortar layer, so that a homogenous appearance of the façade with the shaped profile assembly results. The shaped profile assembly may be covered by a coat of paint or with a film or fleece coating, resulting in color accents.

There has thus been shown and described a shaped profile assembly for bridging a construction element joint which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A shaped profile assembly for bridging a construction element joint between two construction elements, shaped as a stiff joint bridge with two essentially mirror-image vertical profile pieces mounted on both joint edges facing toward each other that are connected by means of a shaped bridging profile that covers the vertical profile pieces and extends over the construction element joint, wherein at least one of the vertical profile pieces is adjustable with respect to the corresponding construction element to compensate for relative displacements between the construction elements, the improvement wherein each of the vertical profile pieces and the shaped bridging profile is formed of a polymer hard foam; wherein the shaped profile assembly, comprised of the assembled vertical profile pieces and said bridging profile is coated on its outer side with a one-piece armoring of a fiber material which is coated with a mortar that serves as an adhesive base for an additional coating layer.

2. Shaped bridging profile assembly as in claim 1, wherein the armoring layer comprises glass-fiber fabric or fleece.

3. Shaped bridging profile assembly as in claim 1, wherein the vertical profile piece, adjustably connected with the construction element, is joined to the respective construction element by means of a long-term plastic layer.

4. Shaped bridging profile assembly as in claim 3, wherein the long-term plastic layer is a plastic material selected from the group consisting of polysulfide rubber, long-term elastic polyurethane filler, and ethylene-propylene rubber.

5. Shaped bridging profile assembly as in claim 1, wherein a space beneath the shaped profile assembly serves as a cable or line channel.

6. Shaped bridging profile assembly as in claim 1, wherein cable or tubular lines are partially or completely embedded in the hard foam.

7. Shaped bridging profile assembly as in claim 1, wherein the shaped profile assembly is mounted on a building façade and over a construction element joint, an outer layer of the building façade having the same texture on both sides of the construction element joint, and wherein the outer layer stretches over the shaped profile assembly without any gap.

8. Shaped bridging profile assembly as in claim 7, wherein the outer layer is a material selected from the group consisting of paint and planking.

* * * * *